US005551875A

United States Patent [19]

Shaffer et al.

[11] Patent Number: 5,551,875

[45] Date of Patent: Sep. 3, 1996

[54] LAND BASED SUBMARINE WEAPONS SYSTEM SIMULATOR WITH CONTROL PANEL TESTER AND TRAINER

[75] Inventors: Stephen G. Shaffer; Connie L. Thome, both of Virginia Beach; Timothy F. Clark, Chesapeake, all of Va.

[73] Assignee: The United States of America as represented by the Secretary of the Navy, Washington, D.C.

[21] Appl. No.: 317,253

[22] Filed: Oct. 3, 1994

[51] Int. Cl.[6] ..... F41A 33/00

[52] U.S. Cl. ..... 434/13; 454/25; 364/578

[58] Field of Search ..... 434/11–14, 25–27; 364/423, 578; 89/1.51, 1.814, 1.809, 1.816, 5

[56] References Cited

U.S. PATENT DOCUMENTS

| | | | |
|---|---|---|---|
| H613 | 4/1989 | Stello et al. | 434/27 X |
| 3,196,199 | 7/1965 | Wolf et al. | 434/13 X |
| 3,808,940 | 5/1974 | Schillreff et al. | 89/1.814 X |
| 3,883,961 | 5/1975 | Limouze | 434/12 |
| 4,232,456 | 11/1980 | Harmon et al. | 434/12 |
| 4,405,985 | 9/1983 | Hall et al. | 364/423 X |
| 4,681,017 | 7/1987 | Fischer et al. | 434/12 X |
| 5,474,454 | 12/1995 | Knapp et al. | 434/25 X |

*Primary Examiner*—Joe Cheng

*Attorney, Agent, or Firm*—Michael J. McGowan; Prithvi C. Lall; Michael F. Oglo

[57] ABSTRACT

A land based launch tube control panel testing and training system for a submarine's launcher interconnects with a launch tube control panel from a submarine to simulate the operation of a submarine weapons launching system to allow for launch tube control panel operational testing and operated and maintenance personnel training. In a simulation mode, a submarine weapons launch tube control panel tester and trainer is responsive to weapons launch system control data signals received from the launch tube control panel, for transmitting to the launch tube control panel weapons launching system operational data signals having a predetermined data type and data value which are a function of the received weapons launching system control data signals. In the training and maintenance mode, the submarine weapons launch tube control panel tester and trainer can provide predetermined fault simulations to allow the training of maintenance personnel, as well as test signals which can be utilized to exercise and verify the operability of a tube control panel.

6 Claims, 2 Drawing Sheets

LAND BASED SUBMARINE WEAPONS SYSTEM SIMULATOR WITH CONTROL PANEL TESTER AND TRAINER

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field Of The Invention

This invention relates to weapons system control panel trainers and testers and more particularly, to a land based submarine weapons system simulator which interfaces with a submarine weapons system control panel, for simulating, on land, the mechanical and electrical features of a submarine's weapons system including weapon firing sequences, and which further allows for weapons system control panel testing and operator training.

(2) Description Of The Prior Art

Control and monitoring of the multiplicity of weapons launch system electrical and mechanical conditions on board a submarine is performed utilizing a control panel which monitors the conditions in the submarine's weapons launching tubes and associated support systems. Such tube control panels (TCP) are complex pieces of electrical apparatus which are expensive to build. These control panels must therefore be extensively tested both periodically once in service as well as before being placed into service. Additionally, since these units are expensive, faults or malfunctions must be isolated and the faulty component(s) repaired or replaced. The complexity of the tube control panels requires the use of skilled and experienced service technicians in order to isolate and repair any faults discovered. Further, given the complexities of the tube control panel, operators must be trained by providing them with many hours of hands-on training.

In the prior art, training of maintenance or service personnel was performed by inserting pre-faulted modules into the tube control panels. These pre-faulted modules were designed to inject a known hardware fault in the control panel. The student was then required to identify the symptoms of the fault, and troubleshoot the source of the problem within the control panel.

The need to constantly insert such pre-faulted modules into the tube control panel, however, was a time consuming task. Moreover, the tube control panel would often become unreliable due to the constant insertion and removal of modules from the system. Most importantly, given the high cost of the tube control panel and its modules, only a limited number of prefaulted modules were manufactured. This greatly limited the types of faults which could be injected or simulated, thereby reducing the effectiveness of the training provided to the maintenance personnel.

Additionally, in order to train tube control panel operators, the prior art training centers had to be equipped with a complete weapons system launch console. The weapons launch console (WLC) is also a very expensive and specialized apparatus which itself requires an additional operator in order to interface the device with and thereby train a tube control panel operator.

Accordingly, what is required is an inexpensive, land based, submarine control panel tester which allows for control panel operation testing as well as operator and system maintenance training. Additionally, what is required is a submarine weapons system simulator which allows the system to interface with and simulate all the mechanical systems and devices of a submarine weapons system, as well as simulation of the weapons firing sequence and it's attendant effects on the weapons firing system and tube control panel.

SUMMARY OF THE INVENTION

The present invention features a land based launch tube control panel testing and training system for a submarine weapons launcher, which interconnects with a launch tube control panel from a submarine, and which simulates the operation of a submarine weapons launching system to allow for launch tube control panel operational testing as well as operator and service personnel training.

The weapons launch tube control panel preferably includes both a port and a starboard launch tube control panel segment. Each of the launch tube control panel segments are adapted for receiving weapons launch system operational data from either a real or a simulated weapons launch system, and for displaying an indication representing the received launch system operational data.

Each of the port and starboard launch tube control panel segments also includes means for transmitting at least weapons launching system control data signals from each of the port and starboard launch tube control panel segments to the coupled launch tube control panel tester and trainer.

The submarine weapons launch tube control panel tester and trainer of the present invention are responsive to the weapons launch system control data signals received from each of the port and starboard launch tube control panel segments, for transmitting to at least one of the port and starboard launch tube control panel segments, at least one weapons launching system operational data signal having a predetermined data type and data value which is a function of the received weapons launching system control data signal.

In the preferred embodiment, the submarine weapons launch tube control panel tester and trainer according to the present invention includes a first input/output device which is coupled to the port launch tube control panel segment, and a second input/output device coupled to the starboard launch tube control panel segment. An operator and controller workstation, which is coupled to the first and second input/output devices is also provided. The operator and controller workstation controls the operation of the first and second input/output devices by establishing the predetermined weapons launching system operational data type and value which is transmitted to the port and starboard launch tube control panel segments as a function of the weapons launch system control data signals received by the first and second input/output devices from the port or starboard launch tube control panel segments.

In the preferred embodiment, the operator and controller workstation may also transmit to each of the port and starboard launch tube control panel segments data signals simulating at least one data fault in either or both of the port and starboard launch tube control panel segments.

Another feature of the present invention is the ability of each of the port and starboard launch tube control panel segments to be responsive to a first plurality of weapons launch console data signals received from a weapons launch console, for at least displaying an indication of the first plurality of received weapons launch console data signals. Additionally, the port and starboard launch tube control panel segments may be responsive to a second plurality of weapons launch console data signals, for passing the second plurality of weapons launch console data signals to the coupled first and second input/output devices.

In this embodiment, the port and starboard launch tube control panel segments may also be responsive to a first plurality of ballast control panel signals, for at least displaying an indication of the first plurality of received ballast control panel signals, and responsive to a second plurality of received ballast control panel signals, for passing the second plurality of ballast control panel signals to the coupled first and second input/output devices.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
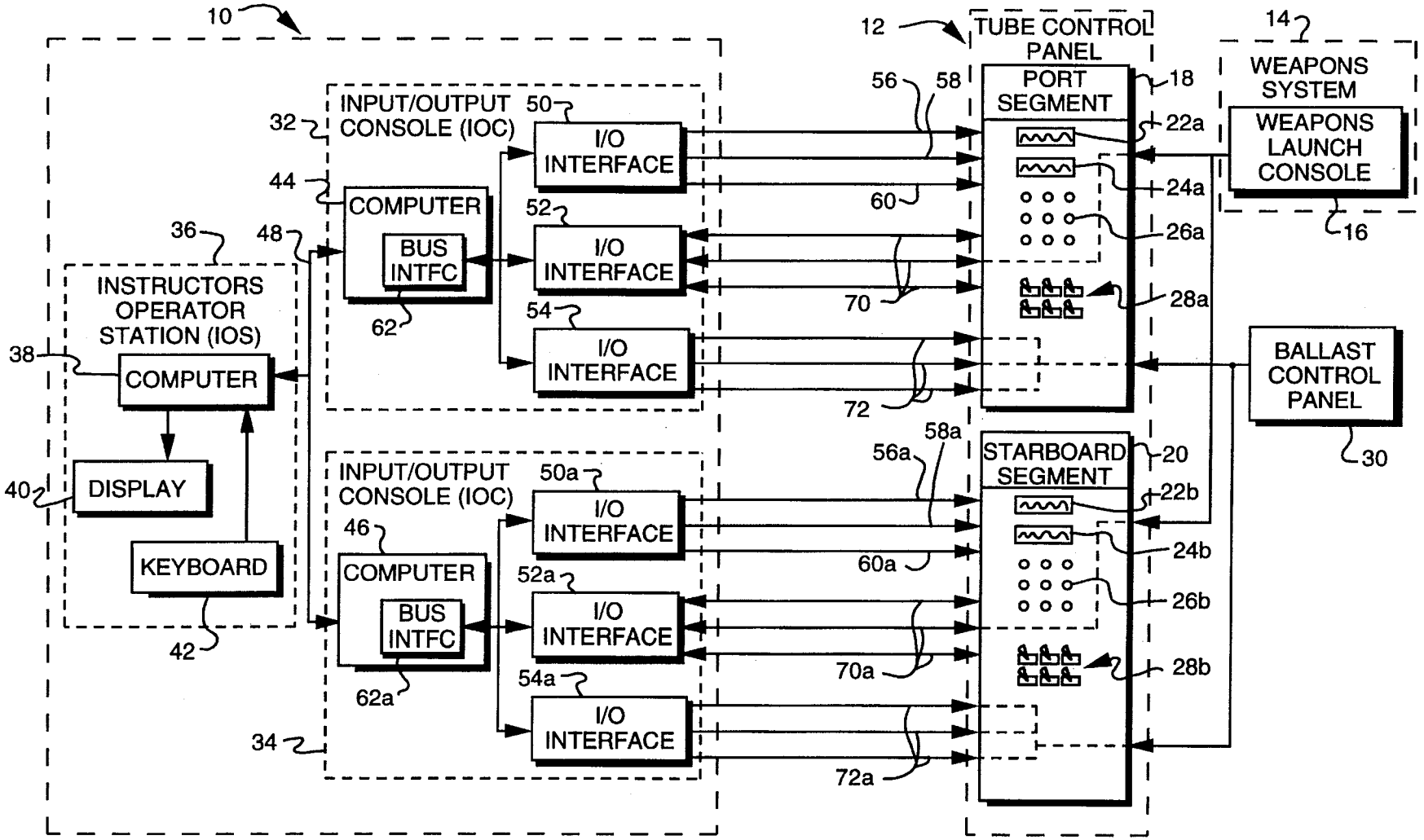
FIG. 1 is a block diagram illustrating the land based, submarine weapons system simulator and control panel tester and trainer of the present invention.

The land based, submarine weapons system simulator with control panel tester and trainer is indicated generally at 10, FIG. 1, and is designed to support testing as well as operator and maintenance training on tube control panel 12 of the type used in SSN-751 series of U.S. Naval vessels and more particularly, submarines. The weapons system simulator and control panel tester and trainer of the present invention provides support for a stand-alone tube control panel 12, or a control panel used in conjunction with a weapons launch system 14 including a weapons launch console 16, by simulating the submarine's weapons launcher system.

Tube control panels used on the above-mentioned class of submarines such as tube control panel 12 include a port segment 18 as well as a starboard segment 20.

The tube control panel 12 is adapted for controlling the environment in the submarines weapons launching system. Such environmental conditions include preparing the weapons launch tubes for weapons launching by properly filling the tubes with water, pressurizing the tubes, monitoring the status of weapons in the tube, draining the water from the tubes after a weapons launch, and setting up the tubes for a subsequent launch. Such weapons launching systems for submarines are well known to those skilled in the art.

The port segment 18 of the tube control panel controls the environment of the weapons launching system on the port side of the submarine, while the starboard segment controls those identical functions on the starboard side of the vessel.

Each of the port and starboard segments of the tube control panel 12 include a large number of indicators such as digital meters 22*a*, 22*b*; pressure gauges 24*a*, 24*b*; and other visual indicators such as LED's 26*a* and 26*b*. Each of these indicators are accompanied by appropriate legends to identify the appropriate indicator. Additionally, each of the port and starboard segments 18, 20 of the tube control panel 12 include a plurality of switches 28*a* and 28*b* which the operator utilizes to set up and control the weapons launching tubes.

As previously described, a submarine includes a complete weapons launching system including tubes, hydraulic and air delivery systems, pistons and ram rods, etc. The launching of the weapons (missiles, torpedoes, etc.) is controlled by a weapons launch console 16 which provides the actual initialization signal to fire the weapon in the tube. Accordingly, the weapons system simulator with control panel tester and trainer according to the present invention is designed to optionally interface with and receive signals from the weapons launch console, in order to simulate an actual weapons firing sequence and to provide the tube control panel 12 with appropriate data signals simulating such a weapons launch.

Additionally, each submarine typically includes a ballast system controlled by ballast control panel 30 which normally interfaces with the tube control panel 12 to provide various ballast readings to the tube control panel. During submarine weapons system simulation, however, the present control panel tester and trainer simulates a ballast control panel selected sea pressure load and transmits this information to the tube control panel 12 as will be described further below.

The land based, submarine weapons system simulator with control panel tester and trainer 10, according to the present invention includes a first input/output console 32 coupled to the port segment 18 of tube control panel 12; a second input/output console 34 coupled to the starboard segment 20 of tube control panel 12; and an operator workstation 36 including a computer 38 such as an IBM PC type computer with a 386 processor operating at 16 megahertz, to which is coupled a display or monitor 40 and input keyboard 42. The operator workstation 36 is utilized as the controller for all operations of the present system. It should be noted that the models mentioned above are for illustrative purposes only and not as limitations.

Each of the first and second input/output consoles also includes an industrial grade, 16 megahertz, 386 based, IBM PC compatible computer 44, 46. Computers 38, 44 and 46 communicate over data signal path 48 which in this embodiment is an ethernet link.

The purpose of the land based, submarine weapons system simulator with control panel tester and trainer of the present invention is to simulate the shipboard electrical environment of the tube control panel 12. Accordingly, the system 10 of the present invention is capable of providing the tube control panel 12 with simulated interfaces to a weapons launch console 16, ballast control panel 30, and a plurality of torpedo tubes, missile tubes, and associated tube bank support systems. In such a role, the weapons systems simulator with control panel tester and trainer 10 of the present invention receives analog and other discreet signals from the tube control panel 12, processes these signals, and provides appropriate analog and discreet response signals to the tube control panel 12.

In one embodiment of the present invention, an operator interfaces with the operator workstation 36 to control and monitor the status of the weapons system simulator with control panel tester and trainer 10 utilizing a windowing system of menus. Thus, utilizing a keyboard, trackball and computer display, an operator is able to perform set up functions to define weapons system simulation parameters; initiate, pause, restart or terminate weapons system simulation; and modify the parameters of a simulation which is in progress.

When in use, torpedo tube, missile tube and associated bank support interfaces consist of discreet and analog outputs from devices such as solenoids, limit switches and analog transducers as well as various miscellaneous sensors. Similarly, the tube control panel 12 normally provides solenoid outputs to these systems, however, which must be received and interpreted by the tube control panel tester and trainer 10.

In order to facilitate the transmission and receipt of such data signals between the tube control panel tester and trainer 10 and the tube control panel 12, each input/output device 32, 34 includes a plurality of printed circuit boards 50–54 and **50*a*–54*a*. The circuit boards are part of a data acquisition system available from a source such as Keithley Metrabyte Corporation of Taunton, Mass. and include a relay printed circuit board, Model No. MEM-32 which can be populated with a plurality of relay modules to provide signals simulating limit switches, weapons launch control signals and starboard to port segment control panel signals 56–60 and 56*a*–60*a* from the input/output devices 32 and 34, respectively, to the port and starboard segments 18, 20 of tube control panel 12**.

The input/output consoles 32, 34 also include a general purpose input/output board 52, **52*a*, Keithley Model No. MSSR-32 which is a 32 channel digital input/output interface for data acquisition purposes. This input/output module may be populated with up to 32 I/O modules to provide either output or input monitoring between the input/output devices 32, 34 and the port and starboard segments of the tube control panel 12**.

Finally, each input/output device 32, 34 includes an analog signal generating system 54, **54*a*** including a Model 500A data acquisition module from Keithley Metrabyte which may be populated with digital-to-analog converters, and other types of analog signal modules, as necessary.

All data acquisition modules are coupled to computer interface modules 62 and **62*a* which is also a Keithley Metrabyte module Model No. MDB-64 driver board which interfaces the various modules 50–54 and 50*a*–54*a* to the computers 44, 46 of the first and second input/output devices 32, 34. Control boards 62, 62*a* allow each computer 44, 46 to interface with a large number of analogue and digital input/output points, and are programmable by the operator workstation 36 through the first and second computers 44, 46**, respectively.

As previously stated, the weapons system launch tube simulator and trainer (TST) 10, of the present invention, is capable of supporting tube control panel (TCP) 12 testing as well as operator and maintenance training on an operational TCP, in a land based facility. The TST simulates the interface between the TCP and a weapons launch console (WLC), ballast control panel (BCP), and multiple torpedo tubes, missile tubes and their associated tube support systems.

The weapons launch tube simulator/trainer 10 of the present invention provides three modes of operation namely set up, simulation and diagnostics.

Figure 2:
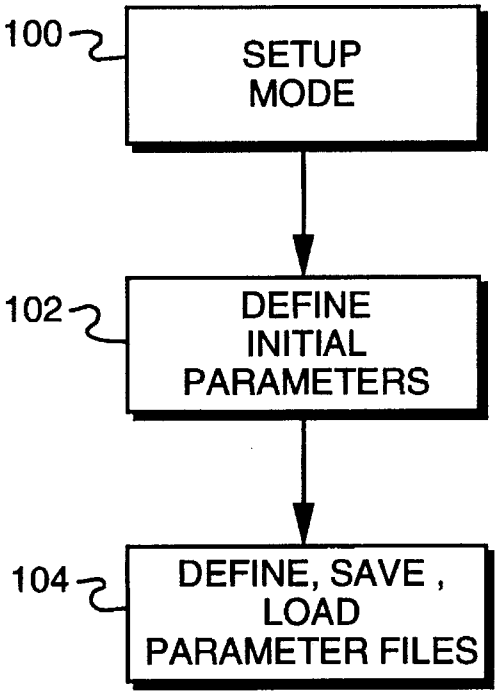
FIG. 2 is a flow chart of the set up mode of an operation of the submarine weapons system simulator and control panel tester and trainer of the present invention.

The set up mode is illustrated beginning at step 100, FIG. 2, and allows the weapons launch tube simulator/trainer operator to define default initial simulation parameters, step 102, and to define, save and load simulation programs, step 104, each program including a number of various simulation parameters.

Figure 3:
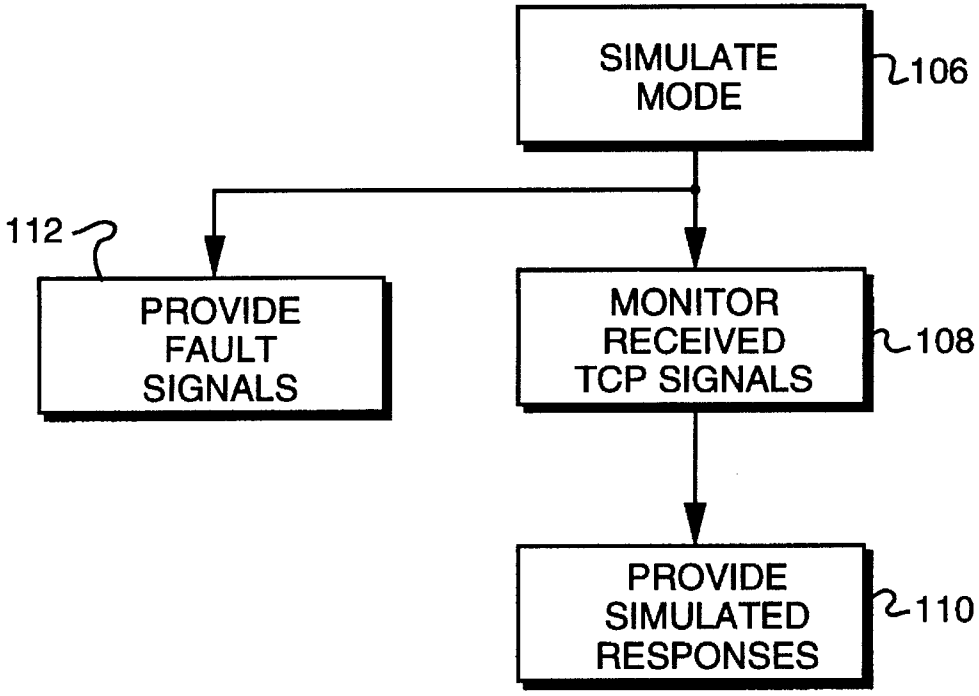
FIG. 3 is a flow chart of the simulation mode of the operation of the submarine weapons system simulator and control panel tester and trainer of the present invention.

In the simulate mode, step 106, FIG. 3, which is selectable from the operator workstation 36, FIG. 1, the TST monitors outputs such as outputs 70, 72 and **70*a*, 72*a*, step 108, FIG. 3, and provides the tube control panel with the correct responses step 110, to the received signals, to simulate actual shipboard operation of various weapons launch systems including the torpedo tubes, missile tubes, weapons launch control panel and various support systems including the ballast control system. This information is provided from the weapons launch system tube simulator/trainer 10, FIG. 1 to the tube control panel 12 over data signal paths 56–60, 56*a*–60*a*, 70 and 70*a***, as appropriate.

In addition to normal shipboard operation, the weapons launch system tube simulator and trainer of the present invention also allows the system operator to select faulted operation, step 112, FIG. 3, by loading and running previously generated and stored files containing information which allows the tube simulator and trainer of the present invention to provide the appropriate "fault" simulation signals to the control panel 12.

A number of device and system simulations are possible utilizing the weapons launch system tube simulator and trainer (TST) with an operational tube control panel (TCP) as illustrated below.

TST/TCP SIMULATION

SEA PRESSURE. The TCP receives sea pressure indications from two sea pressure transducers. The TCP operators select which transducer signal is sent up to the Ballast Control Panel (BCP) and also signal conditions both transducer signals to be used by the TCP.

Simulation.

See pressure is manually controlled by the TST operator at the TST operator station.

MISSILE SUPPORT

DEW POINT MONITORING SYSTEM. The Dew Point Monitoring System is a proprietary air dew point measurement system, based on an aluminum oxide sensor. This system is used to monitor the air dew point of the 700 psig air system.

Simulation

The TST uses discrete capacitors that correspond to specific values of dew point.

DRAIN ISOLATION VALVE. The Drain Isolation Valve is part of the Missile Tube Flood Drain/Header. This is a manual lost motion valve with two limit switches to provide open/shut status. There is one Drain Isolation Valve for the port header and one of the starboard header.

Simulation

The Drain Isolation Valve is controlled manually by the TST operator at the TST operator station. The Drain Isolation Valve open and shut switches normally track the position (open, opening, shutting or shut) of the valve, but each switch can be overridden to provide a stuck on or stuck off condition.

EQUALIZE HULL BACKUP VALVE. The Equalize Hull Backup Valve is part of the Missile Tube Flood/Drain Header. This is a manual valve with two limit switches to provide open/shut status. There is one Equalize Backup Valve for the port header and one for the starboard header.

Simulation

The Equalize Back up Valve is controlled manually by the TST operator at the TST operator station. The Equalize Back up Valve open and shut switches normally track the position (open, opening, shutting or shut) of the valve, but each switch can be overridden to provide a stuck on or stuck off condition.

EQUALIZE HULL VALVE. The Equalize Hull Valve is part of the Missile Tube Flood/Drain Header. This is an electro-hydraulic Valve with two limit switches to provide open/shut status. There is one Equalize Hull Valve for the port header and one for the starboard header.

Simulation

The Equalize Hull Valve is controlled electrically by the TCP. The TCP outputs Equalize Hull Valve Control Valve Solenoid voltage to open the valve. In the absence of this voltage, the valve shuts. The Equalize Hull Valve open and shut switches normally tracks the position (open, opening, shutting or shut) of the valve, but each switch can be overridden to provide a stuck on or stuck off condition.

HEADER FLOOD/DRAIN VALVE. The Header Flood/Drain Valve is part of the Missile Tube Flood/Drain Header. This is an electro-hydraulic Valve with two limit switches to provide open/shut status. There is one Flood/Drain Valve for the port header and one for the starboard header.

Simulation

The Flood/Drain Valve is controlled electrically by the TCP. The TCP outputs Flood/Drain Valve Control Valve Solenoid voltage to open the valve. In the absence of this voltage, the valve shuts. The Flood/Drain Valve open and shut switches normally tracks the position (open, opening, shutting or shut) of the valve, but each switch can be overridden to provide a stuck on or stuck off condition.

HYDRAULIC ACCUMULATOR LEVEL. The Hydraulic Accumulator is part of the Missile Tube Hydraulic System. The Hydraulic Accumulator Level Switch is single pole, double throw level switch that indicates if the accumulator level is above or below 85% volume.

Simulation

The Hydraulic Accumulator level Switch is controlled manually by the TST operator at the TST operator station. The TST operator will select "Charged" or "Not Charged".

HYDRAULIC SS HEADER PRESSURE. The Hydraulic SS Header is part of the Missile Tube Hydraulic System. The Hydraulic SS Header Pressure Switch is a single pole, double throw pressure switch that indicates if the header pressure is greater than or less than 2200 psi.

Simulation

The Hydraulic SS Header Pressure Switch is controlled manually by the TST operator at the TST operator station. The TST operator will select "Normal" or "Low".

INBOARD FLOOD/DRAIN VALVE. The Inboard Flood/Drain Valve is part of the Missile Tube Flood/Drain Header. This is a manual valve with two limit switches to provide open/shut status. There is one Inboard Flood/Drain Valve for the port header and one for the starboard header.

Simulation

The Inboard Flood/Drain Valve is controlled manually by the TST operator station. The Equalize Backup Valve open and shut switches normally tracks the position (open, opening, shutting or shut) of the valve, but each switch can be overridden to provide a stuck on or stuck off condition.

TORPEDO SUPPORT.

40# SERVICE AIR. The 40# Service Air is used to pressurize the WRT Tank and blow down the Torpedo Tubes during the drain cycle. The 40# Service Air Pressure Switch is a single pole, double throw pressure switch that indicates if the pressure is greater than or less than 10 psi.

Simulation

The 40# Service Air Pressure Switch is controlled manually by the TST operator at the TST operator station. The TST operator will select "Normal" or "Low".

150# RAM RETURN AIR. The 150# Ram Return Air is used to return the Ejection Pump Ram to the "At Battery" position. The 150# Ram Return Air Pressure Switch is a single pole, double throw pressure switch that indicates if the pressure is greater than or less than 110 psi.

Simulation

The 150# Ram Return Air pressure Switch is controlled manually by the TST operator at the TST operator station. The TST operator will select "Normal" or "Low".

400# FIRING AIR. The 400 psi Firing Air is the Torpedo Tube Firing Air that rolls the stopbolt and releases the 2000 psi Impulse Air. The 400# Firing Air Pressure Switch is a single pole, double throw pressure switch that indicates if the pressure is greater than or less than 360 psi.

Simulation

The 400# Firing Air Pressure Switch is controlled manually by the TST operator at the TST operator station. The TST operator will select "Normal" or "Low".

3000# OIL. The 3000# Hydraulic Oil is the Torpedo Tube Hydraulics. The 3000# Oil Pressure Switch is a single pole, double throw pressure switch that indicates if the pressure is greater than or less than 2300 psi.

Simulation

The 3000# Oil Pressure Switch is controlled manually by the TST operator at the TST operator station. The Tst operator will select "Normal" or "Low".

AUX TANK FLOOD/DRAIN VALVE. The AUX Tank Flood/Drain Valve is controlled at the BCP, but indicates position on both the BCP and the TCP. This valve is part of the Trim and Drain System and is used to transfer water to and from the AUX Tank.

Simulation

The AUX Tank Flood/Drain Valve is controlled manually by the TST operator at the TST operator station. The Drain Valve Open, Flood/Drain Valve Shut and Flood Valve Open switches normally tracks the position (Drain Valve open or opening, Flood/Drain Valve shut, or Flood Valve shut, or Flood Valve open or opening) of the Flood/Drain Valve, but each switch can be overridden to provide a stuck on or stuck off condition.

EJECTION PUMP DOOR. The Ejection Pump or Sea Chest Door is the water inlet for the Ejection Pump. This is an electro-hydraulic valve with two limit switches to indicate if the door is open or shut. There is one Ejection Pump Door for the port torpedo tubes and one for the starboard torpedo tubes.

Simulation

The ejection Pump Door is controlled electrically by the TCP. The TCP outputs Ejection Pump Door Solenoid voltage to open the door. In the absence of this voltage, the door shuts unless a firing sequence is in process. The Ejection Pump Door switches normally tracks the position (open, opening, shutting or shut) of the door, but each switch can be overridden to provide a stuck on or stuck off condition.

IMPULSE AIR PRESSURE. The Impulse Air Pressure is the 2000 psig air used to move the ejection pump ram during the firing stroke.

Simulation

The Ejection Pump Pressure is manually controlled by the TST operator at the TST operator station.

EJECTION PUMP RAM. The Ejection Pump Ram is a large piston that, when moved, forces water into the torpedo tubes to eject or launch weapons. There is one ejection pump for the port torpedo tubes and one for the starboard torpedo tubes. During an ejection launch, the Firing Solenoid Voltage releases the 400# Firing Air which, provided proper interlocks are satisfied, activates the firing valve to release the 2000 psi impulse air to fire the ram. When the ram reaches the end of its stroke, the system resets. During a swimout launch, the Firing Solenoid Voltage releases the 400# air, but since the slide valve is shut the ram does not fire.

Simulation

The Ejection Pump Ram is fired electrically from the TCP by applying Firing Solenoid Voltage for one of the torpedo tubes in the bank.

WRT TANK FLOOD/DRAIN VALVE. The WRT Tank Flood/Drain Valve is controlled at the BCP, but indicates position on both the BCP and the TCP. This valve is part of the Trim and Drain System and is used to transfer water to and from the WRT Tank.

Simulation

The WRT Tank Flood/Drain Valve is controlled manually by the TST operator at the TST operator station. The Drain Valve Open, Flood/Drain Valve Shut and Flood Valve Open switches normally tracks the position (Drain Valve open or opening, Flood/Drain Valve shut, or Flood Valve open or opening) of the Flood/Drain Valve, but each switch can be overridden to provide a stuck on or stuck off condition.

TORPEDO TUBE.

BLOW VALVE. The Blow Valve is used to pressurize the Torpedo Tube to speedup the drain cycle. This is an electro-hydraulic Valve with two limit switches to provide open/shut status. There is one Blow Valve for each Torpedo Tube.

Simulation

The Blow Valve is controlled electrically by the TCP. The TCP outputs Blow Valve Control Valve Solenoid voltage to open the valve. In the absence of this voltage, the valve shuts. The Blow Valve open and shut switches normally tracks the position (open, opening, shutting or shut) of the valve, but each switch can be overridden to provide a stuck on or stuck off condition.

BREECH RING. The Breech Ring is used to lock or unlock the torpedo tube Breech Door. This is an electro-hydraulic Valve with two limit switches to provide open/shut status. There is one Breech Ring for each Torpedo Tube.

Simulation

The Breech Ring is controlled electrically by the TCP. The TCP outputs Breech Ring Control Valve Solenoid voltage to open the valve. In the absence of this voltage, the valve shuts. The Breech Ring open and shut switches normally tracks the position (open, opening shutting or shut) of the valve, but each switch can be overridden to provide a stuck on or stuck off condition.

FLOOD DRAIN VALVE. The Flood/Drain Valve is part of the Torpedo Tube Flood/Drain System and is used to flood the tube from the WRT Tank and drain the tube to the AUX Tank. This is an electro-hydraulic Valve with two limit switches to provide open/shut status. There is one Flood/Drain Valve for each Torpedo Tube.

Simulation

The Torpedo Tube Flood/Drain Valve is controlled electrically by the TCP. The Drain Valve Open, Flood/Drain Valve Shut and Flood Valve Open switches normally tracks the position (Drain Valve open or opening, Flood/Drain Valve shut, or Flood Valve open or opening) of the Flood/Drain Valve, but each switch can be overridden to provide a stuck on or stuck off condition.

FLOOD AND DRAIN SENSORS. The Flood and Drain Sensors are electrode probes installed in the flood/drain line (Drain Sensor) and the Blow/Vent Manifold (Flood Sensor). When the Flood and Drain Sensors are immersed in salt water, the electrodes short to send 115 vac to the TCP.

Simulation

The flood and drain electrodes are controlled by the TST in response to the state (drained, draining, flooding or flooded) of the Torpedo Tube.

FIRING SOLENOID/STOPBOLT. The Firing Solenoid is a 20 amp solenoid that when actuated, releases 400# Firing Air. The 400# Firing Air rolls the stopbolt to release the weapon, blocks the Muzzle Door open and provided that the slide valve is open on the tube being fired, actuates the Firing Valve to release the 2000# Impulse Air.

Simulation

The Firing Solenoid is manually controlled by the TST operator at the TST operator station. When Firing Solenoid voltage is received from the TCP, the TST will return stopbolt fired followed by the remainder of the firing sequence. The Stopbolt Fired signals remain active until reset by the TST operator.

EQUALIZE VALVE. The Equalize Valve is used to equalize the Torpedo Tube to sea pressure after flooding to allow the Muzzle Door to be opened. This is an electro-hydraulic Valve with two limit switches to provide open/shut status. There is one Equalize Valve for each Torpedo Tube.

Simulation

The Equalize Valve is controlled electrically by the TCP. The TCP outputs Equalize Valve Control Valve Solenoid voltage to open the valve. In the absence of this voltage, the valve shuts. The Equalize Valve open and shut switches normally tracks the position (open, opening, shutting or shut) of the valve, but each switch can be overridden to provide a stuck on or stuck off condition.

MUZZLE DOOR. The muzzle door is the outboard torpedo tube opening through which horizontal weapons are launched. The door is an elector-hydraulic valve which has one limit switch to indicate shut and two limit switches to indicate open. The Muzzle Doors are mechanically linked to the Shutter Doors so that the Shutter Doors open and shut with the Muzzle Doors. When the 400# firing air is released, the Muzzle Door is Blocked until the ram has reached the end of its stroke or in the case of a swimout launch, the Ram Return to Battery Solenoid has been activated.

Simulation

The Muzzle Door is controlled electrically by the TCP. The TCP outputs Muzzle Door Control Valve Solenoid voltage to open the door. In addition to the solenoid voltage, the Breech Door must be locked in order for the Muzzle Door to open. When the tube fires, the Muzzle Door Blocked Switch is set after the Stopbolt rolls and will remain set until the ram has reached the end of its firing stroke (eject launch) or the Ram Return to Battery solenoid is activated (swimout launch). In the absence of Muzzle Door Control Valve Solenoid voltage the door shuts. The Muzzle Door limit switches normally tracks the position (open, opening, shutting or shut) of the door, but each switch can be overridden to provide a stuck on or stuck off condition.

SHUTTER DOOR. The Shutter Door is mechanically linked to the Muzzle Door and will open and shut with the Muzzle Door. The shutter door has two limit switches to indicate open.

Simulation

The Shutter Door Open switches normally tracks the position of the Muzzle Door, but each switch can be overridden to provide a stuck on or stuck off condition.

PRESSURE/VENT CONTROL SYSTEM. The Pressure/Vent Control (PVC) system is used to pressurize the Tomahawk Cruise Missile in its' capsule prior to launch and to release the Tomahawk Capsule or cut the MK48 Guide Wire after launch.

Simulation

The PVC system is controlled electrically by the TCP. The TCP outputs Pressurize Solenoid and vent Blocking Solenoid voltages to increase pressure in the AUR. Presence of Vent Blocking Solenoid voltage without Pressurize Solenoid voltage indicates that the pressure inside the AUR should remain steady and absence of both solenoid voltages indicates that the AUR pressure should decrease.

SLIDE VALVE. The Slide Valve is a sliding sleeve in the Torpedo Tube between the tube and the Impulse Tank which allows water to enter the tube to push a weapon out during an ejection launch. It is an electro-hydraulic valve with two limit switches to indicate open or shut. There is one Slide Valve for each Torpedo Tube.

Simulation

The Slide Valve is normally open and shut with the Muzzle Door. The TCP can output Slide Valve Control Valve Solenoid voltage to shut the Slide Valve during a swimout launch or when the Muzzle Doors for both tubes in a bank are open at the same time (only one slide valve can be open per bank at any give time).

VENT VALVE. The Vent Valve is used to vent the Torpedo Tube to allow air to escape during the flood cycle. This is an electro-hydraulic Valve with two limit switches to provide open/shut status. There is one Vent Valve for each Torpedo Tube.

Simulation

The Vent Valve is controlled electrically by the TCP. The TCP outputs Vent Valve Control Valve Solenoid voltage to open the valve. In the absence of this voltage, the valve shuts. The Vent Valve open and shut switches normally tracks the position (open, opening, shutting or shut) of the valve, but each switch can be overridden to provide a struck on or stuck off condition.

WEAPONS LAUNCH CONSOLE INTERFACE. The Weapons Launch Console (WLC) provides communication between the TCP and the Weapons Launch System (WLS). The WLC sends firing order signals, firing voltage and missile differential pressure for the torpedo tubes to the TCP and the TCP sends torpedo tube status to the WLC.

Simulation

When a WLC is available, it is used to provide the WLC interface with the TCP. If a WLC is not available, the WLC interface is provided by the TST and controlled manually by the TST operator at the TST operator station. If only one bank of the WLC is available, then the interface for the other bank is provided by the TST.

MISSILE TUBE.

FLOOD/DRAIN VALVE. The Flood/Drain Valve is part of the Missile Tube Flood/Drain System and is used to flood the Missile Tube underhatch area from the Missile Tube Flood/Drain Header. This is an electrohydraulic valve with two limit switches to provide open/shut status. There is one Flood/Drain Valve for each Missile Tube.

Simulation

The Missile Tube Flood/Drain is controlled electrically by the TCP. The Flood/Drain Valve Open and Flood/Drain Valve Shut switches normally tracks the position (open, opening, shutting or shut) of the valve but can be overridden to provide stuck on or stuck off conditions.

HATCH. The Missile Tube Hatch is the opening to the missile tube through which weapons are loaded or launched. The Hatch is an electro-hydraulic valve which has two limit switches to indicate open and two limit switch to indicate shut. Additionally, the hatch solenoid control valve has a blocking pin adding the Valve Unblocking Solenoid and Valve Unblocked Switch. The switches normally will track the position (open, opening, shutting or shut and blocked) of the valve but can be overridden to provide stuck on or stuck off conditions.

Simulation

The Hatch is controlled electrically by the TCP. The TCP will output Open Hatch/Shut Flood/Drain Valve Solenoid voltage to open the hatch. When the Hatch Solenoid Control Valve opens, the Hatch Blocked Switch is set. In order to shut the Hatch, the TCP outputs Valve Unblocked Solenoid voltage to unblock the Hatch Solenoid Control Valve. While the hatch is unblocked, the TCP removes Open Hatch/Shut Flood/Drain Valve Solenoid voltage to allow the hatch to shut.

PRESSURE/VENT CONTROL SYSTEM. The Pressure/Vent Control (PVC) system is used to pressurize the Tomahawk Cruise Missile and All Up Round (AUR) prior to launch and for storage.

Simulation

The PVC system is controlled electrically by the TCP. The TCP outputs Pressurize Solenoid voltage to increase the pressure inside the AUR and outputs Vent Solenoid voltage to decrease the pressure inside the AUR. Absence of Both solenoid voltages indicates that the pressure inside the AUR should remain steady.

WEAPONS LAUNCH CONSOLE. The Weapons Launch Console (WLC) provides communication between the TCP and the WLS. The WLC sends firing order signals for the Missile Tubes to the TCP and the TCP sends Missile Tube status to the WLC.

Simulation

When a WLC is available it is used to provide the WLC interface with the TCP. If a WLC is not available, the WLC interface is provided by the TST and controlled manually by the TST operator at the TST operator station. If only one bank of the WLC is available, then the interface for the other bank is provided by the TST.

It should be noted that various components of the system are designated to be specific models as a way of illustration only and not as limitations to practice teachings of subject invention.

In light of the above, it is therefore understood that within the scope of the appended claims, the invention may be practiced otherwise than as specifically described.

What is claimed is:

1. A land based submarine weapons system launch tube control panel testing and training system, for providing operation and maintenance training, said system comprising:

a land based submarine weapons launch tube control panel apparatus including a port launch tube control panel segment and a starboard launch tube control panel segment, each of said port and starboard launch tube control panel segments including means for receiving weapons launch system operational data signals from at least a weapons launch system, and for displaying an indication representing said received weapons launch system operational data signals, each of said port and starboard launch tube control panel segments also including a means for transmitting at least weapons launching system control data signals from each of said port and starboard launch tube control panel segments to said weapons launch system; and a land based submarine weapons launch tube control panel operation and maintenance trainer, coupled to each of said port and starboard launch tube control panel segments, for receiving at least said weapons launching system control data signals transmitted from each of said port and starboard launch tube control panel segments, and responsive to at least one weapons launching system control data signal received from at least one of said port and starboard launch tube control panel segments, for transmitting to said at least one of said port and starboard launch tube control panel segments, at least one weapons launching system operational data signal including a predetermined weapons launching system operational data signal type and data signal value, said weapons launching system operational data signal type and data signal value predetermined as a function of said received at least one weapons launching system control data signal.

2. The system of claim 1 wherein said submarine weapons launch tube control panel operation and maintenance trainer further comprises:

a first input/output device, coupled to said port launch tube control panel segment, for receiving said at least weapons launching system control data signals from said port launch tube control panel segment, and for transmitting to said port launch tube control panel segment, at least one weapons launching system operational data signal;

a second input/output device, coupled to said starboard launch tube control panel segment, for receiving said at least weapons launching system control data signals from said starboard launch tube control panel segment, and for transmitting to said starboard launch tube control panel segment, at least one weapons launching system operational data signal; and an operator and controller workstation, coupled to said first and second input/output devices, for controlling the operation of said first and second input/output devices by establishing said predetermined weapons launch system operational data signal type and data signal value which is transmitted to said at least one of said port and starboard launch tube control panel segments as a function of said at least one received weapons launching system control data signal.

3. The system of claim 2 wherein said operator and controller workstation is also adapted for transmitting to each of said port and starboard launch tube control panel segments, data signal simulating data faults in said port and starboard launch tube control panel segments.

4. The system of claim 2 wherein each of said port and starboard launch tube control panel segments are coupled to a weapons launch console, and responsive to a first plurality of weapons launch console data signals received from said weapons launch console, for at least displaying an indication of said first plurality of said received weapons launch console data signals.

5. The system of claim 4 wherein each of said port and starboard launch tube control panel segments are responsive to a second plurality of weapons launch console data signals received from said weapons launch console, for passing said second plurality of weapons launch console data signals to said coupled first and second input/output devices of said weapons launch tube control panel operation and trainer; and maintenance wherein said operator controller and workstation is responsive to said second plurality of weapons launch console data signals received by said first and second input/output devices, for controlling the transmitting to said at least one of said port and starboard launch tube control panel segments of said at least one weapons launching system operational data signal.

6. The system of claim 2 wherein each of said port and said starboard launch tube control panel segments are responsive to a first plurality of ballast control panel signals, for passing said first plurality of ballast control panel signals to said coupled first and second input/output devices, for controlling the transmitting to said at least one of said port and starboard launch tube control panel segments, of said at least one weapons launching system operational data signal.

* * * * *